US009167851B2

(12) United States Patent
Marchitto et al.

(10) Patent No.: US 9,167,851 B2
(45) Date of Patent: Oct. 27, 2015

(54) CIGARETTE PACKET

(71) Applicant: G.D S.p.A., Bologna (IT)

(72) Inventors: Giuseppe Marchitto, Lugo di Romagna (IT); Lorena D'Alfonso, Lettomanoppello (IT); Stefano Negrini, Calderara di Reno (IT)

(73) Assignee: G.D S.p.A. (IT)

( * ) Notice: Subject to any disclaimer, the term of this patent is extended or adjusted under 35 U.S.C. 154(b) by 0 days.

(21) Appl. No.: 14/415,241

(22) PCT Filed: Jul. 16, 2013

(86) PCT No.: PCT/IB2013/055848

§ 371 (c)(1),
(2) Date: Jan. 16, 2015

(87) PCT Pub. No.: WO2014/013436

PCT Pub. Date: Jan. 23, 2014

(65) Prior Publication Data

US 2015/0164139 A1 Jun. 18, 2015

(30) Foreign Application Priority Data

Jul. 20, 2012 (IT) ..... BO2012A0390

(51) Int. Cl.
*B65D 85/10* (2006.01)
*A24F 15/12* (2006.01)
(Continued)

(52) U.S. Cl.
CPC ..... *A24F 15/12* (2013.01); *B65D 25/205* (2013.01); *B65D 43/16* (2013.01); *B65D 65/22* (2013.01); *B65D 85/1045* (2013.01); *B65D 2203/12* (2013.01)

(58) Field of Classification Search
CPC ..... A24F 15/00; A24F 15/12; B65D 85/1045; B65D 65/22; B65D 25/205; B65D 43/16; B65D 2203/12
USPC ..... 206/265, 268, 271, 273, 459.5; 40/312, 40/313; 229/87.13, 160.1
See application file for complete search history.

(56) References Cited

U.S. PATENT DOCUMENTS 4,696,397 A 9/1987 Nakamats
5,137,148 A * 8/1992 Evers ..... 206/273
(Continued)

FOREIGN PATENT DOCUMENTS

DE 10031942 1/2002
DE 102007004523 7/2008
(Continued)

OTHER PUBLICATIONS

International Search Report dated Feb. 17, 2014 from counterpart PCT App No. PCT/IB2013/055848.

*Primary Examiner* — Luan K Bui
(74) *Attorney, Agent, or Firm* — Timothy J. Kilma; Shuttleworth & Ingersoll, PLC

(57) ABSTRACT

A cigarette packet includes a container containing a group of cigarettes and provided with an opening defining a zone giving access to the group of cigarettes. The container includes a covering element movable between a closed position and an open position which allows access to the zone giving access to the group of cigarettes. The packet includes a mirroring element located at the access zone and having a mirroring surface at least at one portion of it, and the covering element has at least one graphic sign at least at one portion of an inside surface. The portion of the inside surface is taken, when the packet is opened, to a condition where it substantially faces the mirroring surface, such that the graphic sign is reflected on the mirroring surface and is visible to a smoker.

9 Claims, 2 Drawing Sheets

(51) Int. Cl.

| | |
|---|---|
| ***B65D 25/20*** | (2006.01) |
| ***B65D 43/16*** | (2006.01) |
| ***B65D 65/22*** | (2006.01) |

(56) References Cited

U.S. PATENT DOCUMENTS

| | | | | |
|---|---|---|---|---|
| 6,364,106 | B1 * | 4/2002 | Fagg et al. | 206/268 |
| 6,742,652 | B1 * | 6/2004 | Focke et al. | 206/268 |
| 8,322,524 | B2 * | 12/2012 | Mazur | 206/268 |
| 2004/0007491 | A1 * | 1/2004 | Tompkins | 206/459.5 |
| 2007/0062956 | A1 | 3/2007 | Roher | |
| 2007/0221517 | A1 * | 9/2007 | Blome et al. | 206/268 |
| 2008/0029411 | A1 * | 2/2008 | Polloni et al. | 206/268 |
| 2009/0071852 | A1 * | 3/2009 | Negrini | 206/268 |
| 2010/0155274 | A1 * | 6/2010 | de The et al. | 206/271 |
| 2015/0075115 | A1 * | 3/2015 | Valls et al. | 206/268 |

FOREIGN PATENT DOCUMENTS

| | | |
|---|---|---|
| EP | 0905054 | 3/1999 |
| WO | 88/08602 | 11/1968 |
| WO | 2007/060395 | 5/2007 |

* cited by examiner

CIGARETTE PACKET

This application is the National Phase of International Application PCT/IB2013/055848 filed Jul. 16, 2013 which designated the U.S. and that International Application was published under PCT Article 21(2) in English.

This application claims priority to Italian Patent Application No. BO2012A000390 filed Jul. 20, 2012, which application is incorporated by reference herein.

TECHNICAL FIELD

This invention relates to a cigarette packet.

BACKGROUND ART

As is known, cigarette manufacturers use the graphics reproduced on their cigarette packets to convey information, in particular the brand name, but also advertising and other kinds of information.

It is also known that current health regulations in many countries require cigarette packets to have warnings printed on them for the protection of smokers' health and commonly known simply as "health warnings".

These warnings, which may be photographs or written text, are printed in frames appearing mainly on the large faces of the packet.

In order to be dearly visible to the smoker, the frames containing the "health warnings" occupy most of the available space on the packet, defined by the extension of its faces, in particular its large faces.

For that reason, the space available for the other information mentioned above, is considerably reduced.

To overcome this drawback, paper coupons are used on which the desired information is printed. The coupon is inserted into the packet in such a way that the smoker sees it as soon as the packet is opened.

The use of these coupons, however, involves a higher cost for materials and increases the complexity of packaging machines because the coupons have to be inserted into the packets.

DISCLOSURE OF THE INVENTION

This invention therefore has for an aim to provide a cigarette packet which overcomes the above mentioned drawbacks of the prior art.

More specifically, the aim of this invention is to provide a cigarette packet which allows desired information or advertising to be conveyed to the smoker by making the most of the available space and without increasing the constructional complexity of the machine.

According to the invention, this aim is achieved by a cigarette packet having the technical features set out in independent claim 1.

The secondary claims set out other advantageous aspects of the packet according to the invention.

BRIEF DESCRIPTION OF DRAWINGS

These and other innovative features of the invention, as well as the advantages thereby achieved, will become more apparent from the following detailed description of a preferred, non-limiting embodiment of it, illustrated by way of example in the accompanying drawings, in which.

DETAILED DESCRIPTION OF THE PREFERRED EMBODIMENTS OF THE INVENTION

Figure 1:
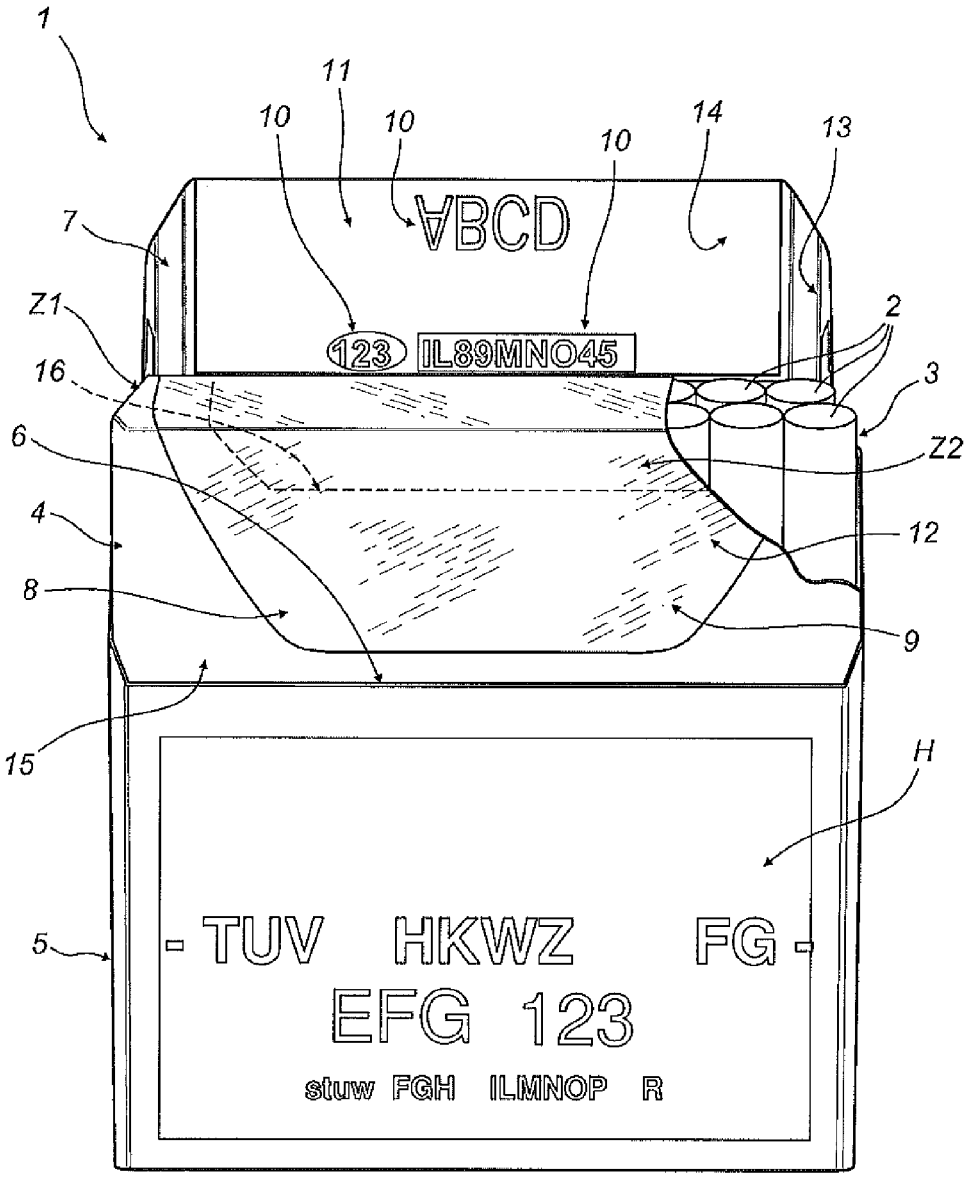
FIG. 1 is a front view, with some parts cut away in order to better illustrate others, showing a packet according to the invention, in a first configuration.

As shown in FIG. 1, the numeral 1 denotes in its entirety a packet for containing a group 3 of cigarettes 2.

The packet 1 comprises a container 5 containing a group 3 of cigarettes 2 and provided with an opening 6 defining a zone Z1 giving access to the group 3 of cigarettes 2.

The group 3 of cigarettes 2 is enclosed in a wrapper 4 of wrapping material.

More specifically, the wrapper 4 is provided with an opening 16 which defines a zone Z2 from which the cigarettes 2 can be taken out.

The packet 1 also comprises a lid 7 hinged to the container 5 and movable relative thereto between an open position and a closed position of the opening 6.

More specifically, the lid 7 constitutes a covering element both of the packet 1 and of the access zone Z1.

It should be noted that, in more general terms and for packets different from those illustrated by way of example, the term "covering element" is used to mean any element or portion of the packet 1 connected to the container 5 in such a way that the covering element 7 and the container 5 are movable relative to each other between a position where the packet 1 is open and a position where it is closed.

The container 5 and the lid 7 are, preferably, made of a stiff paper material, whereas the wrapping material used to enclose the group 3 of cigarettes 2 may be, for example, foil, heat-sealable plastic, or paper.

The packet 1 further comprises a mirroring element 8 having a mirroring surface 9 at least at one portion of it.

The mirroring element 8 is located at the zone Z1 giving access to the group 3 of cigarettes 2.

More specifically, in one embodiment of the packet 1, the mirroring element 8 is located at the aforementioned zone Z2 from which the cigarettes 2 can be taken out.

Precisely, the term "mirroring surface" means that the surface 9 is capable of reflecting both light and images.

More specifically, the mirroring element 8 must be considered as part of the wrapper 4 containing the group 3 of cigarettes 2.

In the preferred embodiment, illustrated in the accompanying drawings, the mirroring element 8 is defined by a closable label 12.

In another embodiment, not illustrated, the mirroring element 8 might be a removable portion of the wrapper 4 which is torn off when the packet 1 is opened for the first time to take out the cigarettes 2.

Figure 3:
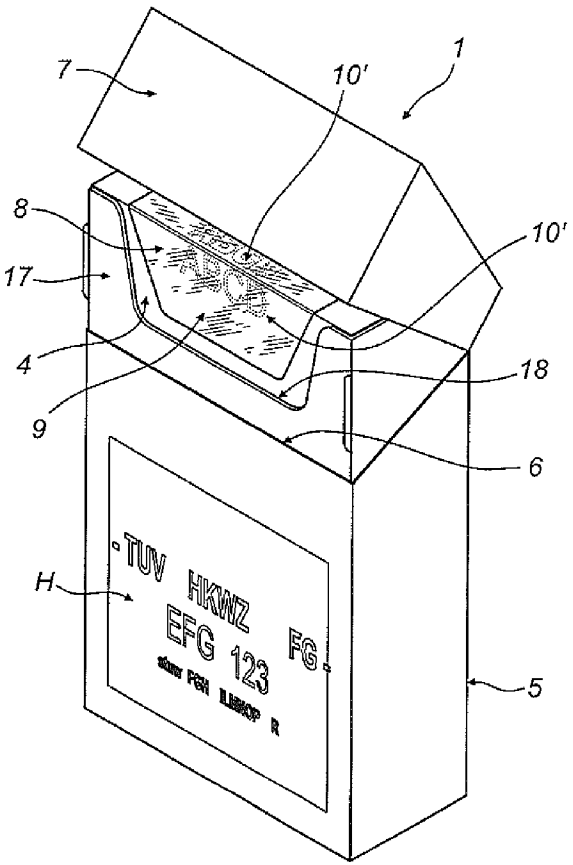
FIG. 3 is a perspective view of a variant embodiment of the packet of FIG. 1.

In a further embodiment of the packet 1, illustrated in FIG. 3, the container 5 is provided with an inner frame 17.

The inner frame 17 is provided with an opening 18 which, in this case, defines the zone Z1 giving access to the group 3 of cigarettes 2.

It should be noted that the mirroring element 8 might be associated with the inner frame 17, for example in the form of a strip of reflective material applied thereto. Alternatively, as illustrated, the container 5 is provided with an inner frame 17 but the mirroring element 8 is part of the wrapper 4, as in the previous embodiment.

As described up to here, the mirroring surface 9 might be located on only one portion of the mirroring element 8 or the whole of the mirroring element 8 might be a mirroring surface.

Alternatively, the entire surface of the wrapper 4 might be a mirroring surface.

Furthermore, as illustrated in FIG. 1, the lid 7, shown fully open, has at least one graphic sign 10 at least at one portion of an inside surface 13 of it.

More precisely, by graphic sign 10 is meant a text or an image as, for example, a symbol or a logo.

These graphic signs 10, besides having a merely aesthetic function, may contain information of various kinds, such as advertising or warnings, to be conveyed to the smoker.

According to this invention, therefore, it is possible to "inform" the smoker by making the graphic signs 10 printed on the inside surface 13 of the lid 7 visible thanks to the reflective property of the mirroring element 8.

In effect, when the packet 1 is opened for the first time, the symbols or text printed on the inside surface 13 are reflected on the mirroring surface 9 of the mirroring element 8, becoming "visible" to the smoker or drawing the smoker's attention to it.

Figure 2:
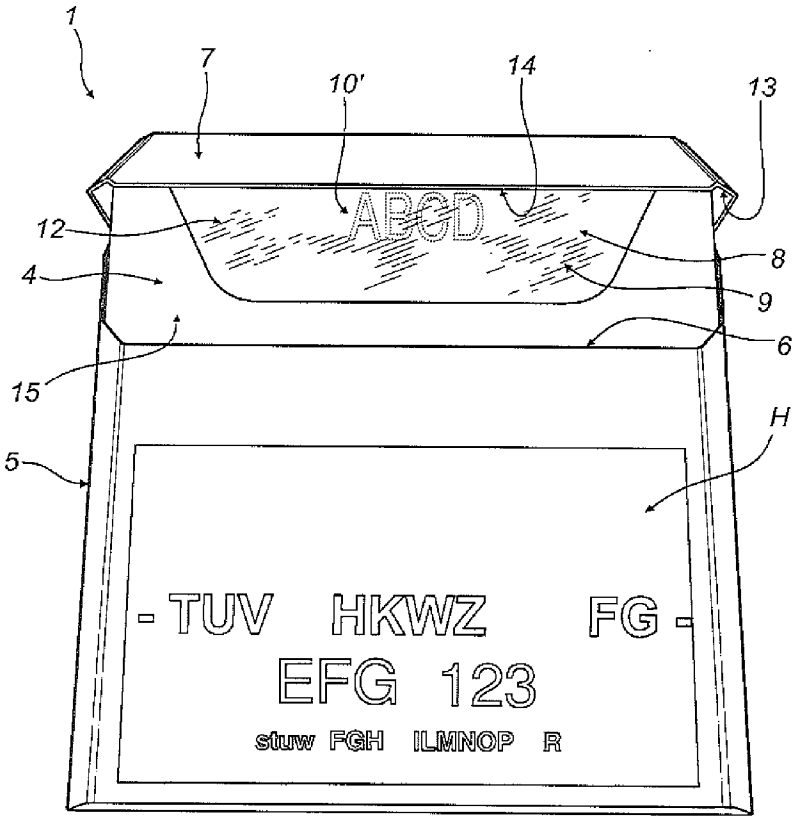
FIG. 2 is a front view of the packet of FIG. 1, in a second configuration.

In FIG. 2, which illustrates a second configuration of the packet 1 where the lid 7 is partly open, the reflected images of the graphic signs 10 printed on the inside surface 13 are labelled 10'.

Also, to be correctly reflected when the packet 1 is opened, the graphic signs 10 must face the mirroring surface 9.

In the preferred embodiment, therefore, these graphic signs 10 are printed on a front inside face 14 of the lid 7, while the mirroring surface 9 is located on a front face 15 of the wrapper 4.

That way, the face 14 is opposite to the mirroring surface 9 when the packet 1 is opened, allowing the graphic signs 10 printed on the face 14 to be reflected.

In the specific case of the embodiment illustrated, by front face 14 of the lid 7 and front face 15 of the container 5 is meant, respectively, the faces of the packet 1 opposite to the faces of the lid 7 and of the container 5, connected to each other by the hinge.

In this case, too, it should be noted that, in more general terms, for packets different from the one illustrated, the lid 7 or the covering element may be connected to different faces or portions of the container 5 which contains the group 3 of cigarettes 2.

It follows that the graphic signs 10 may be printed on any portion of the inside surface 13 of the lid 7, or of the covering element, in such a way that when the packet 1 is opened, the surface 13 is brought to a position where it is substantially opposite to the mirroring surface 9.

That way, the aforementioned graphic signs 10 are made immediately visible to the smoker by reflection on the mirroring surface 9. Similarly, the mirroring surface 9, too, may be located on a face of the container 5 or, preferably, of the wrapper 4, different from the front face 15 but to be able to reflect the graphic signs 10 correctly, the portion of the lid 7 which the graphic signs 10 are printed on and the face which the mirroring surface 9 is located on must be brought to a condition where they are substantially opposite to each other.

In the preferred embodiment illustrated, the graphic signs 10 are printed on a reinforcing flap 11 applied to the inside surface 13 of the lid 7 and for this reason, the flap 11 at least partly defines the selfsame inside surface 13. More specifically, the reinforcing flap 11 is applied to the front inside face 14 of the inside surface 13.

Furthermore, the graphic signs 10 may be of different types.

First of all, at least one of them may be printed specularly on the inside surface 13, in this specific case on the reinforcing flap 11 (FIG. 1) in such a way that the smoker can correctly read or observe it through the image 10' of it reflected on the mirroring surface 9 (FIG. 2).

Also, one or more other graphic signs 10, such as, in particular, those composed of alphanumeric characters and reproducing written information may be printed non-specularly so as to be correctly visible and legible only when the lid 7 is fully open (FIG. 1).

A further type of graphic sign 10 may be defined by an anamorphic sign, also printed, in this specific case, on the flap 11.

A definition of anamorphic image is provided as reference to better understand what is meant by anamorphic sign.

An anamorphic image is an image which is projected onto a plane in such a way that it is distorted and which makes the subject reproduced by the original image recognizable only if the image itself is viewed from a particular angle.

In other words, if the anamorphic graphic sign were observed directly as reproduced on the reinforcing flap 11, it would appear distorted and illegible.

Thus, to obtain a correct reproduction of the sign, in this case, its reflection must be observed after moving the lid 7 to a precise opening angle.

The angle may vary, for example, according to the "degree" of anamorphism to which the graphic sign 10 has been made and also based on the size of the reflective surface 9, so as to obtain a complete reproduction of the image or text.

Another type of graphic sign 10 is a holographic sign.

The holographic sign, again definable by an image or text, is reproduced, in this case, not on the inside surface 13 or on the reinforcing flap 11, but directly on the reflective surface 9.

The holographic sign, too, becomes visible to the smoker when the mirroring surface 9 is observed from a precise angle and with the incident light at a defined angle.

In particular, each graphic sign 10 may contain all the information to be conveyed to the smoker or it may be combined with others to obtain all the information.

In other words, for example, the holographic sign may constitute part of the information to be conveyed to the smoker. Thus, the information to be conveyed can be made complete by combining the holographic sign with one or more of the reflected images 10' of the other types of graphic signs 10 described above.

The packet 1 as described, therefore, allows required information to be conveyed to the smoker, in terms of current regulations on the protection of smokers' health, without appearing on the surfaces on which the health warnings are printed.

Moreover, the mirroring surface 9 may also simply be used to draw the smoker's attention to a zone made available for reproducing information, that is to say, to the inside surface 13 of the lid 7, which would not otherwise be immediately identifiable.

Furthermore, it is possible to use the mirroring surface 9 to reflect different types of graphic signs 10, which can be used individually or in combination with each other to convey the information, thereby improving the overall graphic and visual effect of the information to be conveyed.

The invention described above is susceptible of industrial application. It may be modified and adapted in several ways without thereby departing from the scope of the inventive concept. Moreover, all the details of the invention may be substituted for technically equivalent elements.

The invention claimed is:

1. A cigarette packet comprising:

a container containing a group of cigarettes and including an opening defining a zone giving access to the group of cigarettes, a covering element for covering the access zone connected to the container;

the container and the covering element being reciprocally movable between a position where the packet is open and a position where the packet is closed;

a mirroring element located at the access zone and having a mirroring surface at least at one portion of the mirroring element;

the covering element having at least one graphic sign at least at one portion of an inside surface of the covering element; said portion of the inside surface being taken, when the packet is opened, to a condition where the inside surface substantially faces the mirroring surface, in such a way that the graphic sign is reflected on the mirroring surface and is visible to a smoker.

2. The packet according to claim 1, and further comprising a wrapper of wrapping material enclosing the group of cigarettes, and the mirroring element is part of the wrapper.

3. The packet according to claim 2, wherein the mirroring element is a closable label.

4. The packet according to claim 2, wherein the mirroring element is a removable portion of the wrapper.

5. The packet according to claim 1, and further comprising a reinforcing flap applied to the inside surface of the covering element and at least partly defining the inside surface, wherein the at least one graphic sign is reproduced on the reinforcing flap.

6. The packet according to claim 1, wherein the at least one graphic sign is reproduced specularly on the inside surface of the covering element.

7. The packet according to claim 1, wherein the at least one graphic sign is anamorphic.

8. The packet according to claim 1, wherein the at least one graphic sign is holographic and the mirroring element has the at least one graphic sign reproduced on the mirroring surface.

9. The packet according to claim 1, wherein the covering element is a lid hinged to the container.

* * * * *